US010388471B2

(12) United States Patent
Greitner et al.

(10) Patent No.: US 10,388,471 B2
(45) Date of Patent: Aug. 20, 2019

(54) ACTUATOR HAVING A MECHANICAL SIGNAL DISPLAY

(71) Applicant: Siemens Aktiengesellschaft, Munich (DE)

(72) Inventors: Markus Greitner, Schwarzenfeld (DE); Waldemar Hensch, Regensburg (DE); Alexander Keintzel, Nuremberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/303,587

(22) PCT Filed: Apr. 16, 2014

(86) PCT No.: PCT/EP2014/057739

§ 371 (c)(1),
(2) Date: Oct. 12, 2016

(87) PCT Pub. No.: WO2015/158380

PCT Pub. Date: Oct. 22, 2015

(65) Prior Publication Data

US 2017/0032908 A1 Feb. 2, 2017

(51) Int. Cl.

| | |
|---|---|
| ***H01H 13/14*** | (2006.01) |
| ***H01H 3/02*** | (2006.01) |
| ***H01H 9/16*** | (2006.01) |

(52) U.S. Cl.

CPC ..... *H01H 13/14* (2013.01); *H01H 3/022* (2013.01); *H01H 9/16* (2013.01); *H01H 2235/01* (2013.01)

(58) Field of Classification Search

CPC ..... H01H 2219/062; H01H 13/83; H01H 2221/07; H01H 13/023; H01H 2219/06; H01H 13/705; H01H 13/704; H01H 2209/07; H01H 25/065; H01H 25/06; H01H 25/04; H01H 19/14; H01H 25/008; H01H 2221/01; H01H 3/08; H01H 19/003; H01H 19/20; H01H 2025/048; H01H 19/11; H01H 19/025; H01H 9/182; H01H 23/025; H01H 9/181; H01H 2219/014; H01H 15/025

USPC ..... 200/310–317, 4, 530, 341, 43.11, 308, 200/318.2, 566

See application file for complete search history.

(56) References Cited

U.S. PATENT DOCUMENTS

| | | | | |
|---|---|---|---|---|
| 3,855,961 | A | 12/1974 | Schadow | |
| 5,605,225 | A | 2/1997 | Schaeffer | |
| 8,227,716 | B2 | 7/2012 | Demleitner et al. | |
| 2010/0219054 | A1* | 9/2010 | Demleitner | H01H 3/022 200/290 |
| 2012/0048695 | A1* | 3/2012 | Liebetruth | H01H 3/30 200/308 |

FOREIGN PATENT DOCUMENTS

| | | |
|---|---|---|
| DE | 2 220 812 A1 | 11/1973 |
| DE | 2 231 966 A1 | 1/1974 |
| DE | 28 15 255 A1 | 10/1978 |
| DE | 10 2007 046 999 B3 | 1/2009 |
| EP | 2 296 159 A1 | 3/2011 |

* cited by examiner

*Primary Examiner* — Ahmed M Saeed
(74) *Attorney, Agent, or Firm* — Cozen O'Connor

(57) ABSTRACT

An actuator for switching a switching unit includes a mechanical display having a window and a display surface visible through said window, where the display surface is positioned at a guiding projection that is subjected to a force from an elastic element.

16 Claims, 8 Drawing Sheets

ACTUATOR HAVING A MECHANICAL SIGNAL DISPLAY

CROSS-REFERENCE TO RELATED APPLICATIONS

This is a U.S. national stage of application No. PCT/EP2014/057739 filed 16 Apr. 2014.

BACKGROUND OF THE INVENTION

1. Field of the Invention

The invention relates to an actuator for switching a switching unit and including a mechanical display having a window and a display face discernible through the window.

2. Description of the Related Art

Electromechanical control units are used extensively to operate and control machines and installations. Such units come in various forms, for example, as pushbuttons, toggle switches, key switches or emergency off switches. Control units are mounted on control panels, operator panels, switch cabinet doors or housing covers. By manual actuation of the control units, electrical changes to the switching state and thus the desired control effects are brought about. Control units are equipped as standard with a mechanical display in order to display prevailing switching states, where the mechanical display may alternatively or additionally be equipped with an illuminable or illuminated unit.

Control units generally have a modular structure. This means that they consist of a pressure knob, a fastening part, such as a ring nut or a mounting holder, and at least one switching element or a plurality of switching elements which are formed as make-contact or break-contact elements. For assembly, the actuator is generally guided from the front through a hole in the control panel and mounted from the rear via a fastening part. The switching elements are mechanically fastened to the actuator or to the fastening part by screws, snap-fits or catches. The electrical connection of the switching elements to the control occurs via connection terminals.

In safety applications, such as emergency off control units, it is stipulated that the signal be generated by the opening of positive-opening contacts. Consequently, in the case of an unactuated emergency off control unit, the contacts and thus the associated circuit are closed. In the event of a fault or emergency, the break contact is interrupted by the emergency off actuator, which is located in front of the control panel, being struck and the installation or machine is thus transferred into a safe state. However, this only works if the spatial assignment between the actuator and switching element is ensured. As a result of defective mounting or of violent impacts, it is possible for the switching elements to become mechanically separated from the actuator. In this case, the emergency off control unit is no longer operational. As a result, in the event of actuation in an emergency, the contacts are not opened and thus the hazardous state is also not rectified. This can have fatal consequences for humans and machinery. Therefore, the secure connection between the actuator and switching elements is of considerable importance.

The demand for an integrated optical display, which may be both a mechanical and/or an electrical switch display, causes problems with regard to the accommodation of the necessary components, because the overall volume of the unit can be varied only within narrow boundaries, in particular as a result of a standardized construction diameter of 22.5 mm, for example. Hitherto, when it was not possible to integrate the display in the control unit, an additional control station, such as having a signal lamp, was added. On account of the additional space requirement, for example, on a control panel of the installation unit and the necessary use of a separate display, this solution is disadvantageous.

To this end, DE 102007046999 B3 discloses an actuator that is provided for switching a switching unit and that has a mechanical display, where the mechanical display includes a window and a display face that is discernible through the window. Here, the display face is connected to a spring web attached to an actuating part of the actuator and is provided for partial rotation about a rotation axis together with at least one part of the spring web during an actuating movement of the actuating part. Here, the rotation axis is oriented substantially perpendicularly to the actuating movement of the actuating part.

The disadvantage of this conventional actuator the prior art is that the mechanical display face is guided via very slender mechanical components which, on account of the confined space in the control unit, can easily tilt or deform and consequently no longer allow the control unit to be operated as stipulated.

SUMMARY OF THE INVENTION

In view of the foregoing, it is therefore an object of the present invention to provide an actuator having a mechanical signal display, which is kept structurally simple and which allows reliable operation.

This and other objects and advantages are achieved in accordance with the invention by an actuator, which includes a mechanical display, for switching a switching unit, where the mechanical display has a window and a display face discernible through the window. In accordance with the invention, the display face is positioned on a guide web and the guide web is subjected to a spring force by a spring element.

The aim is to move a display face behind a window of the control unit, i.e., a window of the actuator, such that at least one display face is moved into or out of the window. Alternatively, a plurality of display faces are also conceivable, which can each be seen through a window by the user in different switching states.

The mechanical display of the control unit, i.e., the emergency off switch, has one or more windows, one or more display faces and one or more guide webs attached to the actuating part of the actuator. A guide web is coupled, connected or even integrally connected to a display face. Together, the spring web and the provided display face or display faces produce an indicator. The guide web has the object both of holding the display face and, on account of its resilient property and length, of moving the display face in a defined manner behind or in the window.

On account of the mechanical and integral connection of the guide web to the actuating part or one of its components, the guide web and its display face, i.e., the entire indicator, execute the actuating movement of the actuating part. In addition, the guide web is forced to at least partially change its relative position with respect to the actuating part. This happens in that the guide web butts against a stationary component, such as a stationary collar, for example, and is elastically loaded.

In addition, the guide web now performs, in addition to the movement in the actuating direction, a partial rotary movement which occurs about a rotation axis that is oriented perpendicularly to the actuating direction. Finally, a part of the actuating force that is transmitted via the actuating part is deflected by the non-moved stationary component such that the guide web is elastically loaded and thus the display face is moved.

In a particularly advantageous embodiment of the invention, the display face and the guide web is formed in one piece. On account of the one-piece configuration, no additional coupling point is required between the display face and guide web.

In an alternative embodiment, the spring element comprises a separate component. The spring element is in this case configured and positioned such that it cannot tilt in the cylindrical body of the actuator.

In a specific embodiment of the invention, the display face and the guide web are made of plastic material. Plastic material has the advantage that it is not subject to any aging process.

In a further advantageous embodiment of the invention, the display face and the guide web are punched from a sheet metal strip. The production of the display face and the guide web from a sheet metal strip has the advantage that this is a very simple production and can be implemented without significant effort.

In a particularly preferred embodiment of the invention, the guide web is formed in an S-shaped manner, where the display face is arranged at one end and a peg-like device for receiving the spring element is arranged at the other end of the guide web. The S-shaped embodiment of the guide web has the result that the guide web pass the guide web, through the side walls formed in the cylindrical main body of the actuator because, in particular, the S-shaped indentations in the guide web bear against the walls.

In a particularly advantageous embodiment of the invention, the spring element includes a plug-in opening via which the spring element is arranged on the peg-like device of the guide web.

The plug-in opening in the spring element allows a peg-like device of the guide web to be positioned fixedly.

In a specific embodiment of the invention, the spring element includes a tensioning lever that bears against the guide web and subjects the guide web to a spring force. These inventive measures allow resetting of the guide web including the display face.

In a particularly preferred embodiment of the invention, when the actuator is actuated, the guide web, including the display face, executes a rotary movement from the outside inward in the direction of the center of the actuator. This defined back-and-forth movement, in the event of triggering and in the normal state, allows a reliable display of the particular state of the actuator.

The combinations of features listed above can be used in particular in a control unit, preferably in an emergency off switch.

The actuator in accordance with the invention, preferably a control and signaling unit, has a cylindrical main body and a cap in which at least one window is arranged, preferably in which a plurality of windows are arranged. The at least one window forms part of a mechanical display that additionally comprises a display face that provides the user of the control and signaling unit with information as to whether the control and signaling unit is in the actuated or unactuated state.

The display face is positioned at one end of the guide web that is guided inside the cylindrical main body of the actuator. Arranged at the other end of the guide web is a peg-like device, which engages in cutouts in the cylindrical main body of the actuator, thereby forming a fixed point that allows a rotary movement of the guide web in the direction of the center of the cylindrical main body.

The guide web is subjected to a force by a resilient element, preferably a spring element or a rubber ring, which allows the display face to be reset from the actuated state into the unactuated state. In this case, the resilient element can assume different embodiments.

The actuator in accordance with disclose embodiments of the invention having a mechanical signal display is distinguished by a robust, structurally simple configuration that allows reliable operation and is additionally cost-effective to implement, because it is possible to dispense with punched and bent parts. The configuration of the display allows preassembly, which as a whole contributes to making the assembly of the entire unit significantly easier.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and embodiments of the invention are explained in the following text by way of exemplary embodiments and by way of the drawing, in which, schematically.

DETAILED DESCRIPTION OF THE EXEMPLARY EMBODIMENTS

Figure 1:
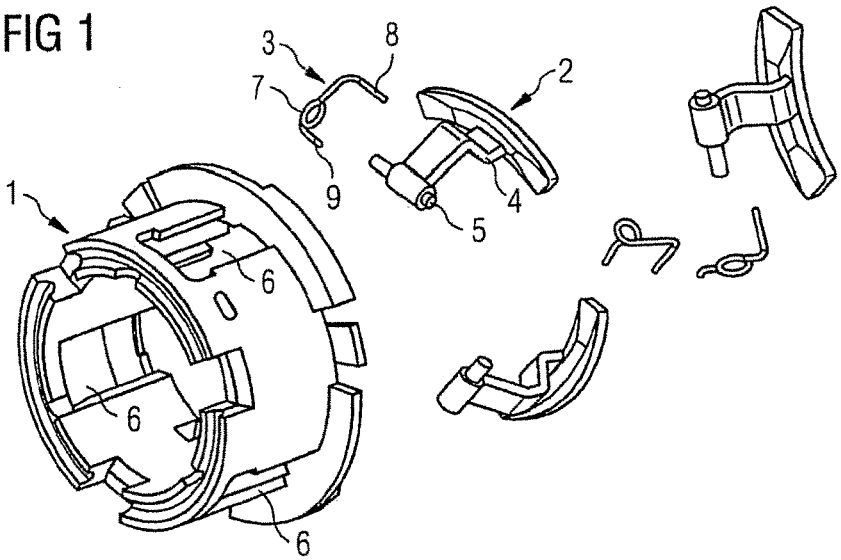
FIG. 1 shows a perspective exploded illustration of a cylindrical main body of an actuator, preferably of a control and signaling unit having display faces and a first exemplary embodiment of a resilient element in accordance with the invention.

FIG. 1 shows a cylindrical main body 1 of an actuator, preferably of a control and signaling unit with a display face 2 and a first exemplary embodiment of a resilient element 3. The display face 2 is positioned at one end of a guide web 4 that is preferably configured in an S-shaped manner. Arranged at the other end of the guide web 4 is a peg-like device 5. Arranged in the cylindrical main body 1 of the actuator are cutouts 6 that serve to receive and fix the guide webs 4 and the peg-like device 5. For further fixing of the display faces 2 in the cylindrical main body 1 of the actuator, the resilient element 3 is provided, which is configured as a spring element in this exemplary embodiment. The spring element subjects the guide web 4 of the display face 2 to a spring force such that it is possible to reset the display face 2 from the actuated state into the unactuated state. The resilient element 3 with spring properties has two end regions 7, 8 and a tensioning ring 9 mounted between these end regions 7, 8.

Figure 2:
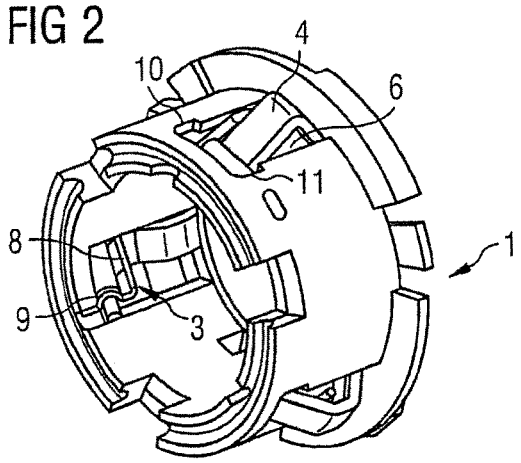
FIG. 2 shows a perspective illustration of the cylindrical main body with fitted display faces in accordance with the invention.

FIG. 2 illustrates the cylindrical main body 1 of the actuator with fitted display faces 2 and fitted elastic element 3. The guide web 4 of the display face 2 is positioned in the cutout 6 in the cylindrical main body 1. Indentations 10, 11 in which the peg-like device 5 on the guide web 4 engages are additionally positioned in the cutout 6. The guide web 4 is furthermore fixed by the resilient element 3 with spring properties. In this case, the end region 8 of the resilient element bears against the guide web 4 on the inner side of the cylindrical main body 1. The tensioning ring 9 of the resilient element 3 is positioned laterally next to the guide web 4 in the interior of the cylindrical main body 1. The end region 7 of the resilient element 3 is firmly fixed in a receiving pocket in the inner side of the cylindrical main body 1.

Figure 3:
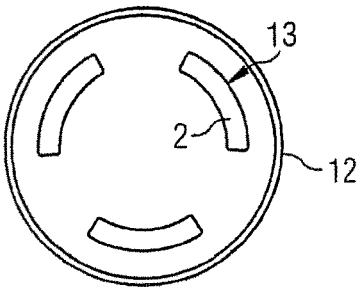
FIG. 3 shows a plan view of a cap of the actuator, preferably of a control and signaling unit having display faces in accordance with the invention.

FIG. 3 illustrates a cap 12 of an actuator, preferably of a control and signaling unit with display faces 2 that are visible through windows 13 in the cap 12. Preferably, a plurality of windows 13 and thus a plurality of display faces 2 are also provided in the cap 12.

Figure 4:
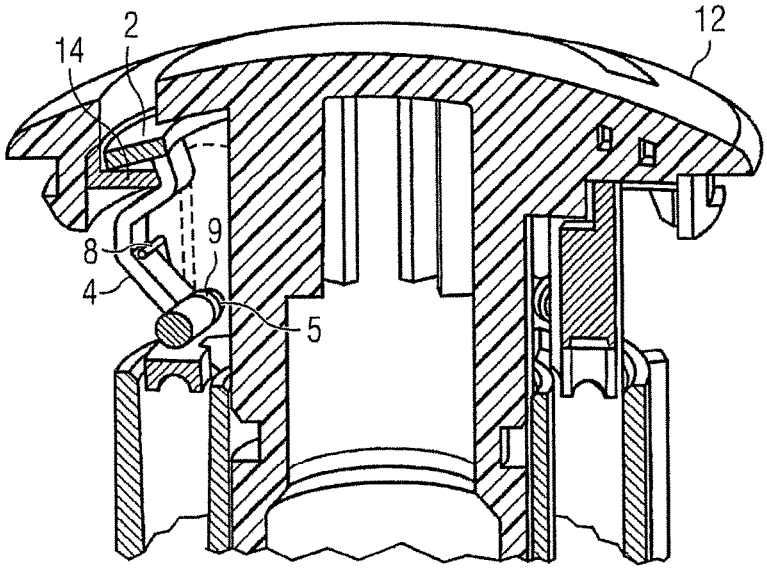
FIG. 4 shows a perspective sectional illustration of an actuator with display faces in an unactuated state in accordance with the invention.

FIG. 4 shows the actuator in accordance with the invention with display faces 2 in the unactuated state. It is also apparent from this illustration that the tensioning ring 9 of the resilient element 3 has been plugged onto the peg-like device 5 on the guide web 4, while the end region 8 of the resilient element 3 rests on the inner side of the guide web 4. Positioned beneath the display face 2 is a further display face 14 that is firmly fixed to the cap 12 of the actuator and can be seen in the actuated state of the actuator, because in this case the display face 2 pivots away inward.

Figure 5:
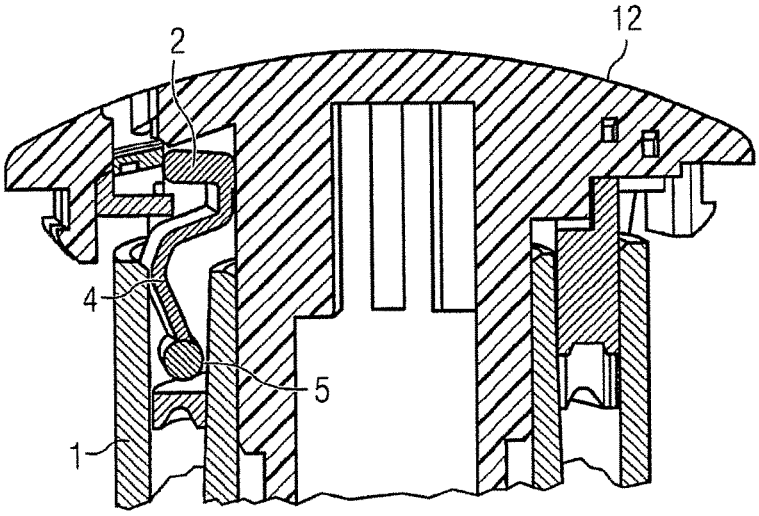
FIG. 5 shows a perspective sectional illustration of an actuator with display face in an actuated state in accordance with the invention.

FIG. 5 shows the actuator in accordance with the invention with display faces 2 in the actuated state. It is apparent from this illustration that the cylindrical main body 1 of the actuator serves as a guide rail for the guide web 4, such that the display face 2 pivots away inward toward the center of the actuator in the actuated state.

Figure 6:
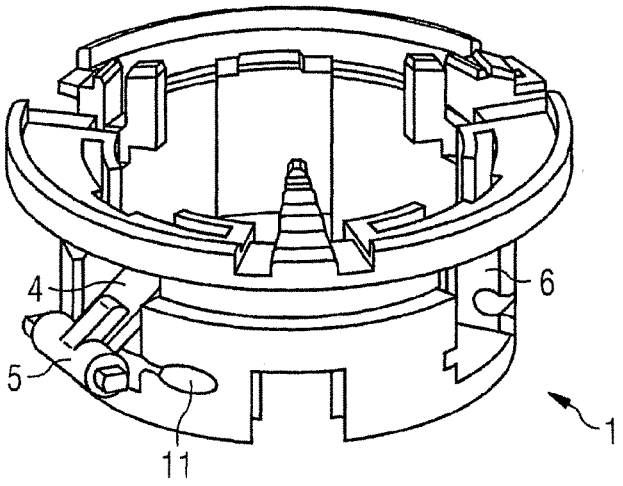
FIG. 6 shows a perspective illustration of a cylindrical main body of an actuator with cutouts for receiving the display faces in accordance with the invention.
Figure 7:
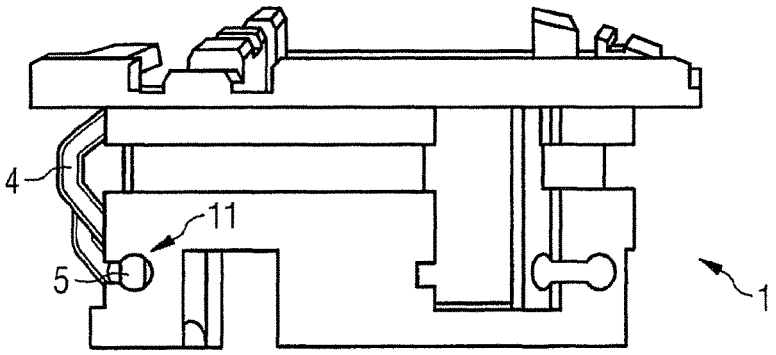
FIG. 7 shows a side view of the display faces fixed in the cylindrical main body in accordance with the invention.

FIGS. 6 and 7 once again illustrate the fixing of the guide web 4 in the cutout 6 in the cylindrical main body 1. The engagement of the peg-like device 5 in the indentation 11 is apparent in particular from FIG. 7.

Figure 8:
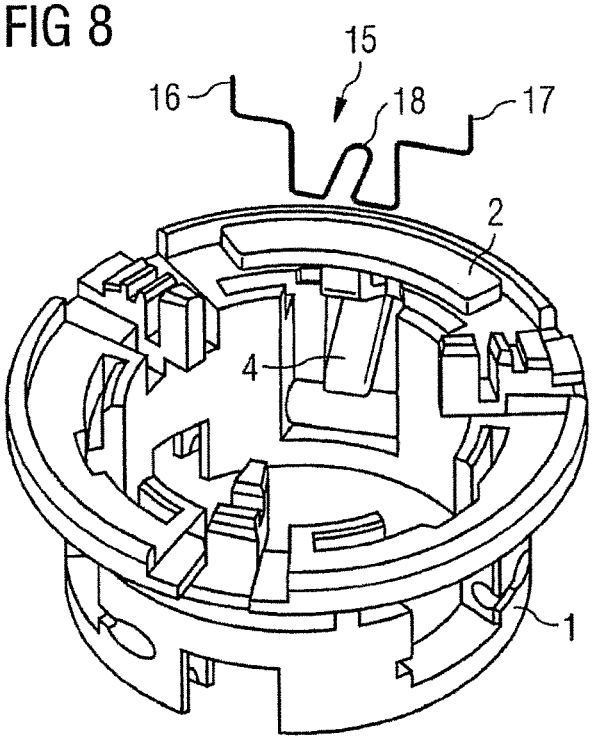
FIG. 8 shows a perspective exploded illustration of a cylindrical main body of an actuator with fitted display faces and a second exemplary embodiment of a resilient element in accordance with the invention.

FIG. 8 shows a cylindrical main body 1 of an actuator with fitted display faces 2 and a second exemplary embodiment of a resilient element 15 with spring properties. The resilient element 15 in accordance with the invention is preferably constructed symmetrically with end regions 16, 17 that serve as lateral means for fixing in the cylindrical main body 1, and with a central region 18 that is preferably configured as a U-shaped bow.

Figure 9:
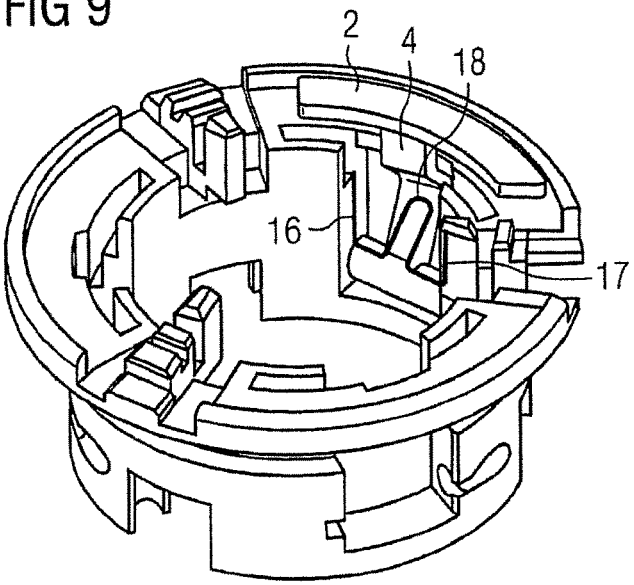
FIG. 9 shows a perspective illustration of the cylindrical main body of FIG. 8 with a fitted display face and a fitted second resilient element in accordance with the invention.

FIG. 9 shows the cylindrical main body 1 of FIG. 8 with fitted resilient element 15. It is apparent from this illustration that the central region 18 of the resilient element 15 is positioned on the inner side of the guide web 4 of the display face 2, and the end regions 16, 17 of the resilient element 15 are fixed to the right and left of the guide web 4 in the housing region, which is preferably made of a plastic material, of the cylindrical main body 1.

Figure 10:
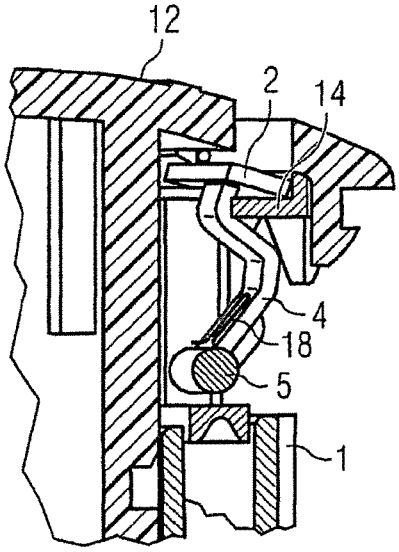
FIG. 10 shows a perspective illustration of a detail of an actuator of FIGS. 8 and 9 in an unactuated state in accordance with the invention.

FIG. 10 illustrates the actuator in accordance with the invention with display faces 2 in the unactuated state. It is particularly apparent from this illustration that the central region 18 of the resilient element 15 rests on the lower region of the guide web 4 configured in an S-shaped manner. In this case, the additional display face 14 is also positioned beneath the display face 2, which is firmly fixed to the cap 12 of the actuator and can be seen in the actuated state of the actuator, because the display face 2 pivots away inward here.

Figure 11:
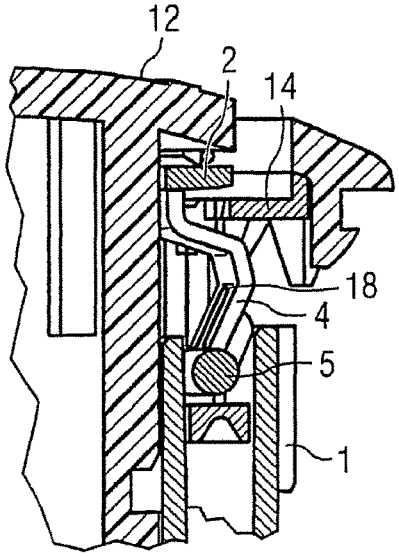
FIG. 11 shows a perspective illustration of a detail of an actuator of FIGS. 8 and 9 in an actuated state in accordance with the invention.

FIG. 11 shows the actuator in accordance with the invention with display face 2 in the actuated state. It is apparent from this illustration that the cylindrical main body 1 of the actuator serves as a guide rail for the guide web 4 such that the display face 2 pivots away inward toward the center of the actuator in the actuated state.

Figure 12:
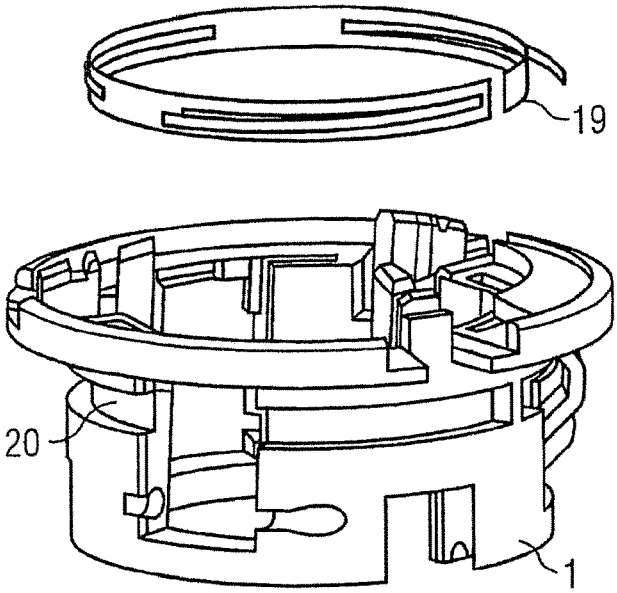
FIG. 12 shows a perspective exploded illustration of a cylindrical main body of an actuator with a third exemplary embodiment of a resilient element in accordance with the invention.

FIG. 12 illustrates a cylindrical main body 1 of an actuator with a third exemplary embodiment of a resilient element 19. The resilient element 19 in accordance with the invention is preferably configured as a flat spiral spring and formed in a concentric manner. Provision is made for this flat spiral spring to engage in a groove 20 in the cylindrical main body 1.

Figure 13:
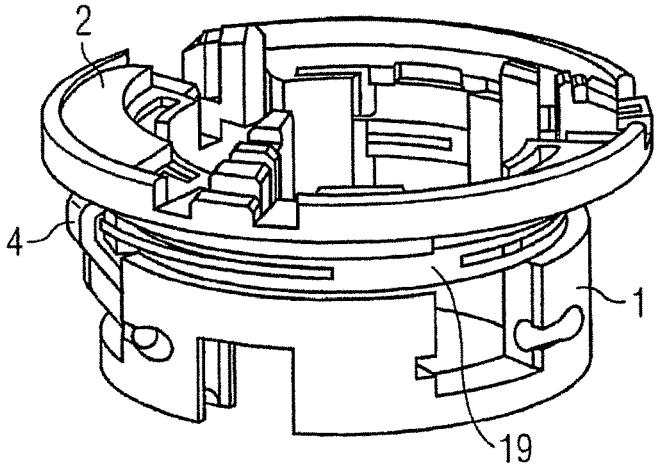
FIG. 13 shows a perspective illustration of the cylindrical main body of FIG. 12 with fitted display face and fitted resilient element in accordance with the invention.

FIG. 13 shows the cylindrical main body 1 of FIG. 12 with fitted, resilient element 19 and a fitted display face 2. It is apparent from the illustration in FIG. 13 that the resilient element 19 bears against the inner side of the guide web 4 configured in an S-shaped manner.

Figure 14:
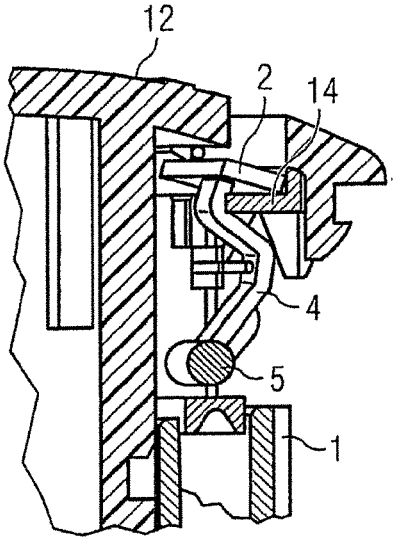
FIG. 14 shows a perspective illustration of a detail of an actuator of FIGS. 12 and 13 in an unactuated state in accordance with the invention.

FIG. 14 illustrates the actuator in accordance with the invention with display faces 2 in the unactuated state. It is apparent from this illustration that the resilient element 19 in the form of a flat spiral spring is also positioned in the central region of the S-shaped guide web 4. Positioned beneath the display face 2, here too, is a further display face 14 that is firmly fixed to the cap 12 of the actuator and can be seen in the actuated state of the actuator, because here the display face 2 pivots away inward.

Figure 15:
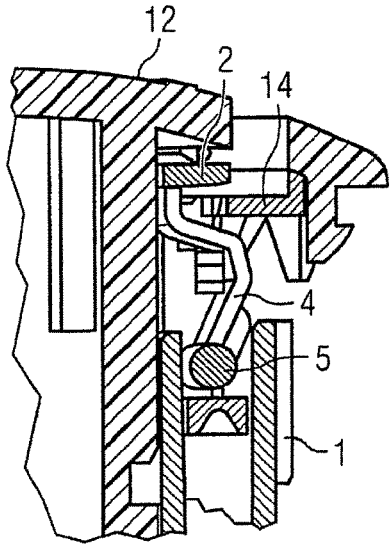
FIG. 15 shows a perspective illustration of a detail of an actuator of FIGS. 12 and 13 in an actuated state in accordance with the invention.

FIG. 15 shows the actuator of FIG. 14 in accordance with the invention with display faces 2 in the actuated state. It is apparent from this illustration that the cylindrical main body 1 of the actuator serves as a guide rail for the guide web 4 such that this display face 2 pivots away inward toward the center of the actuator in the actuated state.

Figure 16:
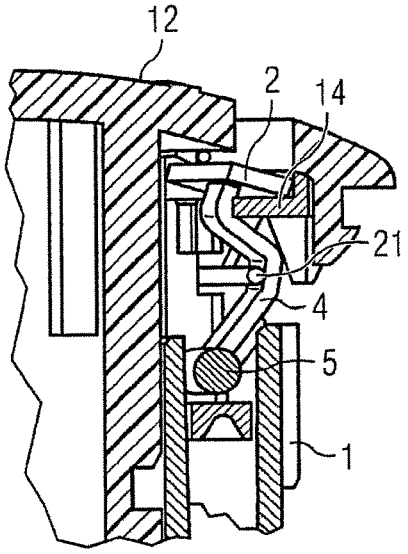
FIG. 16 shows a perspective illustration of a detail of an actuator with a fourth exemplary embodiment of a resilient element in an unactuated state in accordance with the invention.

FIG. 16 shows a cylindrical main body 1 of an actuator with fitted display faces and a fourth exemplary embodiment of a resilient element 21 in the unactuated state. The resilient element 21 in accordance with the invention is preferably configured as a rubber ring, in particular as a sealing ring. Just like the resilient element 19, the resilient element 21 also bears against the inner side of the guide web 4 of the display face 2 in the central region. Positioned beneath the display face 2, here too, is a further display face 14 that is firmly fixed to the cap 12 of the actuator and can be seen in the actuated state of the actuator, because the display face 2 pivots away inward in this case.

Figure 17:
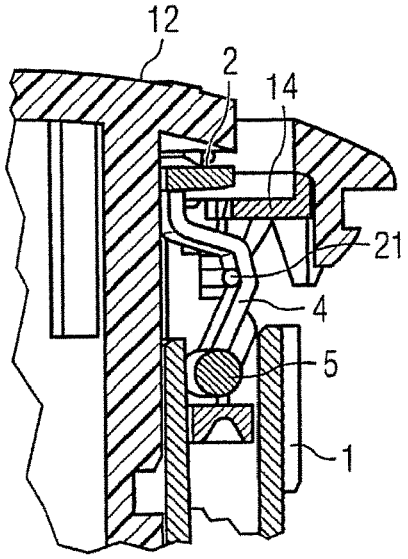
FIG. 17 shows a perspective illustration of a detail of an actuator of FIG. 16 in an actuated state.

FIG. 17 shows the actuator of FIG. 16 in accordance with the invention with display faces 2 in the actuated state. It is apparent from this illustration that the cylindrical main body 1 of the actuator serves as a guide rail for the guide web, such that the display face 2 pivots away inward toward the center of the actuator in the actuated state.

The actuator in accordance with the disclosed embodiments the invention having a mechanical signal display is distinguished by a robust, structurally simple configuration that allows a reliable operation and is additionally cost-effective to implement, because it is possible to dispense with punched and bent parts. The configuration of the display allows preassembly, which contributes as a whole to making the assembly of the entire unit significantly easier.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An actuator for switching a switching unit, comprising;

a mechanical display having a window and a movable display face discernible through the window;

a stationary further display face separate from the mechanical display, said stationary further display face having an indicia and being arranged below and being covered by the movable display face discernible through the window;

a resilient element; and a guide web, the movable display face being positioned on the guide web and the guide web being subjected to a force by the resilient element and pivoting to move the movable display face and uncover the stationary further display face.

2. The actuator as claimed in claim 1, wherein the movable display face and the guide web are formed in one piece.

3. The actuator as claimed in claim 1, wherein the movable display face and the guide web comprise a plastic material.

4. The actuator as claimed in claim 1, wherein the resilient element is configured as a separate component.

5. The actuator as claimed in claim 1, wherein the guide web is formed in an S-shaped manner; and wherein the movable display face is arranged at one end and a peg-like device is arranged at another other end of the guide web.

6. The actuator as claimed in claim 1, wherein the resilient element comprises a spring element having two end regions and a tensioning ring.

7. The actuator as claimed in claim 1, wherein the resilient element comprises a symmetrical spring element in which a central region of the resilient element is arranged on an inner side of the guide web.

8. The actuator as claimed in claim 1, wherein the resilient element comprises a concentric flat spiral spring.

9. The actuator as claimed in claim 1, wherein the resilient element comprises a rubber ring.

10. A control unit, comprising:

an actuator for switching a switching unit, the actuator comprising:

a mechanical display having a window and a movable display face discernible through the window;

a stationary further display face separate from the mechanical display, said stationary further display face having an indicia and being arranged below the movable display face discernible through the window;

a resilient element; and a guide web, the movable display face being positioned on the guide web and the guide web being subjected to a force by the resilient element and pivoting to move the movable display face and uncover the stationary further display face.

11. The control unit of claim 10, wherein the control unit comprises an emergency off switch.

12. The actuator as claimed in claim 1, wherein the stationary further display face is fixedly attached to a cap of the actuator.

13. The actuator as claimed in claim 1, wherein the movable display face pivots inward towards a center of the actuator in an actuated stated.

14. The control unit of claim 10, wherein the stationary further display face is fixedly attached to a cap of the actuator.

15. The control unit of claim 10, wherein the movable display face pivots inward towards a center of the actuator in an actuated stated.

16. An actuator for switching a switching unit, comprising;

a mechanical display circumferentially arranged with respect to a center of the actuator, said mechanical display having a window and a display face discernible through the window;

a further display face oriented along a central axis of the actuator, said further display face having an indicia and being arranged below the display face discernible through the window;

a resilient element arranged along the central axis of the actuator; and a guide web circumferentially disposed about the central axis of the actuator, the display face being positioned on the guide web and the guide web being subjected to a force by the resilient element.

* * * * *